United States Patent [19]

Getoor et al.

[11] Patent Number: 4,759,165

[45] Date of Patent: Jul. 26, 1988

[54] ROOFING PANEL ASSEMBLY AND METHOD OF MAKING SAME

[75] Inventors: Richard C. Getoor, Madeira; Michael D. Pottinger, Anderson Township, Hamilton County, both of Ohio

[73] Assignee: American Building Components Company, Cincinnati, Ohio

[21] Appl. No.: 869,194

[22] Filed: May 30, 1986

[51] Int. Cl.[4] ..... E04D 3/368; E04D 3/38

[52] U.S. Cl. ..... 52/528; 52/531; 52/537; 52/539; 52/747; 29/425; 29/521; 29/527.7; 29/DIG. 32

[58] Field of Search ..... 52/528, 529, 530, 531, 52/536, 741, 747, 537, 539; 29/425, 521, 527.7, DIG. 3, DIG. 32

[56] References Cited

U.S. PATENT DOCUMENTS

| | | | |
|---|---|---|---|
| 396,605 | 1/1889 | Sagendorf | 52/528 |
| 659,177 | 10/1900 | Moomaw | 52/529 |
| 3,394,515 | 7/1968 | Widdowson | 52/536 X |
| 3,495,363 | 2/1970 | Johnson | 52/531 X |
| 4,196,554 | 4/1980 | Anderson | 52/528 |
| 4,223,503 | 9/1980 | Hague | 52/530 X |

FOREIGN PATENT DOCUMENTS

| | | | |
|---|---|---|---|
| 1336774 | 7/1963 | France | 52/529 |

*Primary Examiner*—David A. Scherbel
*Assistant Examiner*—Richard E. Chilcot, Jr.
*Attorney, Agent, or Firm*—James W. Pearce; Roy F. Schaeperklaus

[57] ABSTRACT

A roofing panel assembly including, in combination, a first roofing panel and a second roofing panel. Each roofing panel comprises a body plate portion and an edge attaching portion. The edge attaching portion of the first roofing panel includes an outwardly extending plate portion, a bridge plate portion offset from the body portion, a transition portion, and a return bend flange portion. A sealant strip extends lengthwise of the transition portion and between the bridge plate portion and return bend flange. The edge attaching portion of the second roofing panel includes an outwardly extending plate portion, a bridge plate portion offset from the body plate portion, a first return bend flange, a transition portion of the second roofing panel, a second return bend flange, an inwardly extending plate portion, and an attachment flange. Means in the attachment flange attaches the attachment flange to a sheathing member. The transition portion of the second roofing panel engages the sealing strip to form a seal between the roofing panels. Each roofing panel may be manufactured by roll forming to an intermediate configuration in which the return bend portion and bridge plate portion of the edge attaching portion of the first panel are coupled by and diverge from the transition portion having a concave face facing a smaller angle included between the bridge plate and return bend portions, forming and attaching a bead of sealant to the concave face of the transition portion and roll forming of the panel so the transition portion supports the return bend flange and bridge plate portion in spaced opposed relation with the sealant bead therebetween.

6 Claims, 2 Drawing Sheets

ROOFING PANEL ASSEMBLY AND METHOD OF MAKING SAME

BACKGROUND OF THE INVENTION

This invention relates to an interlocking panel construction for a roof or the like and a method of making same.

An object of this invention is to provide an interlocking panel construction which forms a substantially continuous sealed panel structure.

SUMMARY OF THE INVENTION

Briefly, the invention provides for mounting on the exterior surface of a building a panel structure in which a panel is employed having a body plate portion and edge attaching portions or sections along opposite edges of the body plate portion. A first edge attaching portion includes an outwardly extending sloping plate portion, a bridge plate portion substantially parallel with the body plate portion but offset therefrom and away from the building surface, a curved transition portion, and a return bend flange. A bead or strip of sealant is formed inside the curved transition portion between the bridge plate portion and the return bend flange. A second edge attaching portion includes an outwardly extending sloping plate portion, a bridge plate portion substantially parallel with the body portion but offset therefrom and from the building surface, a first return bend plate portion, a transition portion, a second return bend plate portion in substantially flatwise relation to the first return bend plate portion, an inwardly directed second sloping plate portion extending toward the building surface, and an attachment flange. Fasteners extending through openings in the attachment flange can attach the panel to a supporting surface. An edge of the transition portion between the first and second return bend portions can engage the sealing bead of an adjacent panel to form a seal between the edge attaching portions of adjoining panels.

The invention further provides a method of manufacture of a panel structure, which method comprises partially roll forming a sheet of metal to have a bridge plate portion and the return bend flange of the first edge seal forming portion connected and supported by a curved transition portion having a concave surface facing the smaller angle included between the bridge plate portion and the return bend flange, adhering a convex surface of a bead of sealing to the concave surface of the curved transition portion and further roll forming the sheet to place the return bend flange in spaced opposed relation to the bridge plate portion and increase the area of adherence of the bead of sealant to the surface of the panel structure.

The above and other objects and features of the invention will be apparent to those skilled in the art to which this invention pertains from the following detailed description and the drawing, in which:

DESCRIPTION OF PRESENTLY PREFERRED EMBODIMENT

Figure 1:
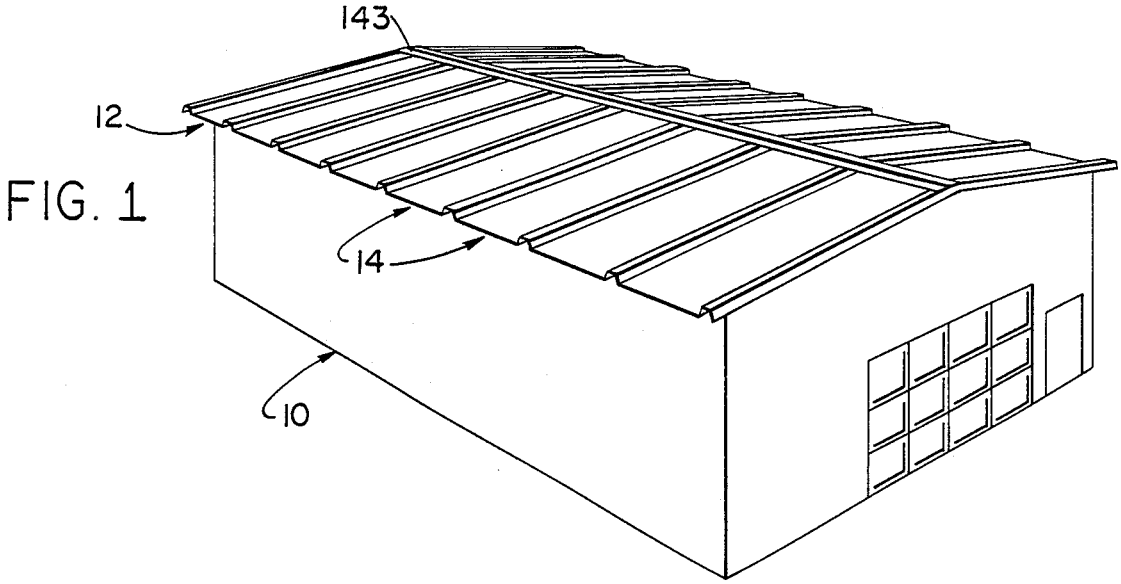
FIG. 1 is a somewhat schematic perspective view of a building having a roof formed of panels constructed in accordance with an embodiment of this invention.

In the following detailed description and the drawings, like reference characters indicate like parts.

Figure 2:
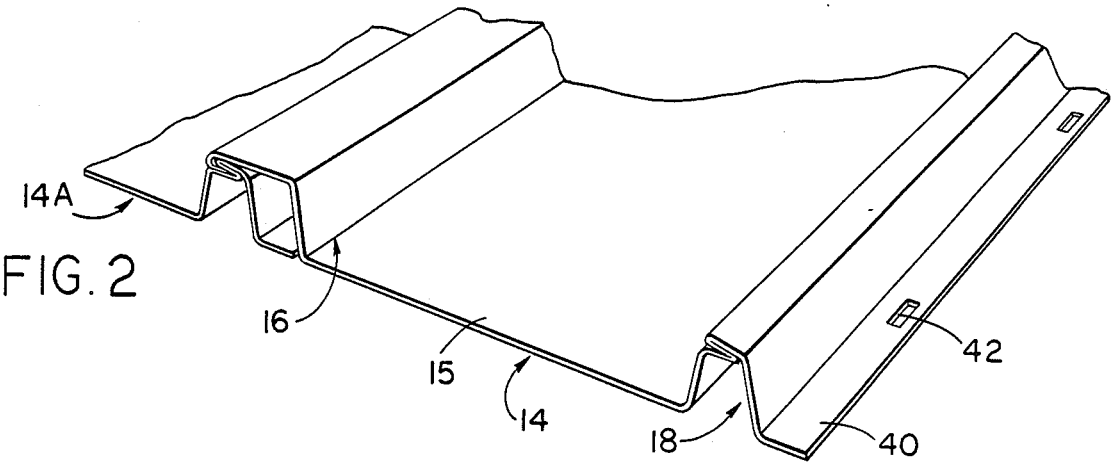
FIG. 2 is a perspective view of fragmentary portions of two adjoining panels of the roof.
Figure 3:
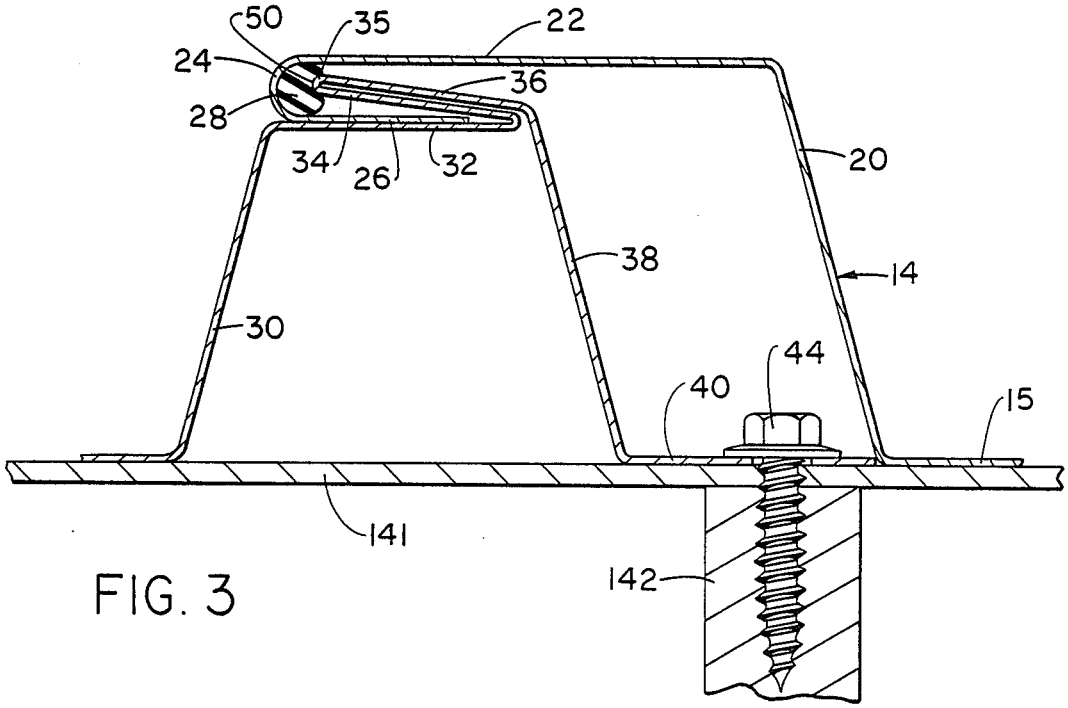
FIG. 3 is a fragmentary view in section of fragmentary portions of two adjoining panels of the roof and of supports for the roof.
Figure 4:
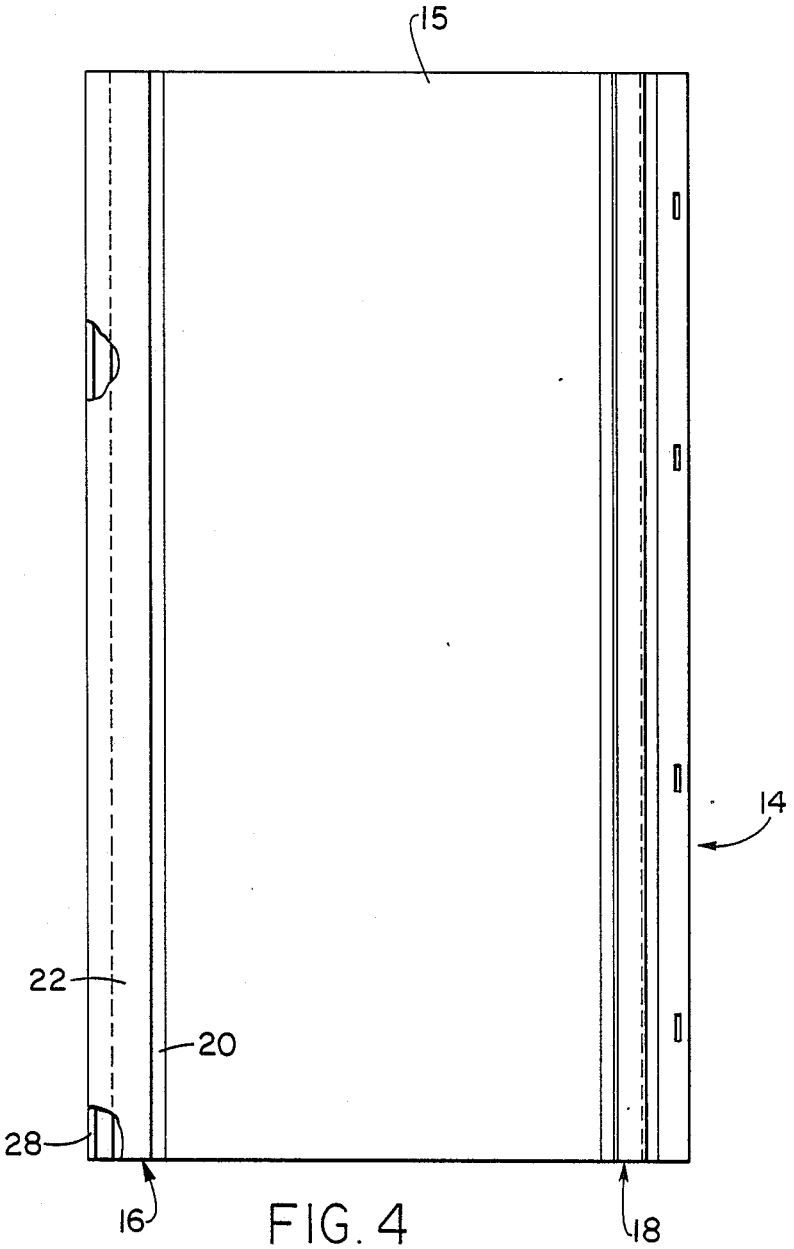
FIG. 4 is a plan view of one of the panels, the panel being partly broken away to reveal structure.

In FIG. 1 is shown a building 10 equipped with a roof assembly 12 formed of panels 14, the panels being constructed in accordance with an embodiment of this invention. The panels 14 are supported by sheathing 141 supported by appropriate framing elements 142. The panels can be assembled with a ridge cap member 143 of usual form, not shown in detail. As shown in FIG. 2, each of the panels 14 includes an elongated body plate portion 15 and first and second edge seal forming portions 16 and 18 along opposite lengthwise edges of the body plate portion 15. The body plate portion 15 rests flatwise on the sheathing 141.

The first edge seal forming portion 16 includes integrally with a first edge of the body plate an outwardly sloping plate portion 20, which is formed along a first lengthwise edge of the body plate portion 15, a bridge plate portion 22 parallel to but offset from the body plate portion 15, a curved transition portion 24, and a return bend flange portion 26. The bridge plate portion 22 and the return bend flange portion 26 are connected by the curved transition portion 24. The bridge plate portion 22 connects the curved transition portion 24 to the sloping plate portion 20. A bead 28 of sealant is mounted inside the curved transition portion 24 at the time of manufacture of the panel and extends the length of the panel 14.

Figure 5:
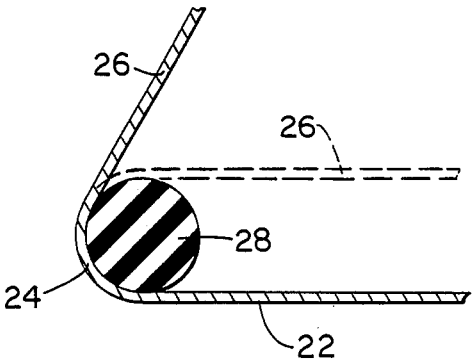
FIG. 5 is a fragmentary view in transverse section of the first edge attaching portion showing the bridging, curved transition and return bend flange portions in intermediate relation to a bead of sealant in full lines and the return bend flange in dash lines in fully formed relation.

The panel may be roll formed in a plurality of successive roll forming operations in which the return bend flange 26 and curved transition portion 24 are formed to an intermediate relation to bridge plate portion 22 as shown in full lines in FIG. 5. A bead of sealant 28 is formed and mounted in adhering relation to the concave surface of curved transition portion 24 and the roll forming of the panel is thereafter completed to place the return bend flange in the dashed line position of FIG. 5 in which it is in spaced opposed relation to the bridge plate portion with the sealant bead in adhering relation to the concave surface of the curved transition portion 24 and filling the curved transition portion. The sealant bead 28 may be formed and applied to the concave face of the curved transition portion by extrusion from a gun positioned between successive roll forming stations, not shown, as the panel is progressively roll formed as it advances through successive roll forming stations. The bead is preferably formed from a material which remains substantially permanently soft, flexible, tacky and non-sagging under temperature and other conditions to which such panels are normally exposed. Further, such panels are usually painted, wherefore the sealant should also be both non-staining and non-deteriorating as to painted surfaces and non-corrosive as to metal and other materials as well.

The second edge seal forming portion 18 includes, in series, an outwardly sloping plate portion 30, which is formed along, integral with and extends from a second lengthwise edge of the body plate portion 15, a bridge plate portion 32 parallel to but offset from the body plate portion 15, a first return bend flange 34 which overlies but is spaced from the bridge plate portion 32, a short curved transition portion 35, a second return bend flange 36 which is substantially flatwise with the first return bend flange 34 of the second edge seal forming portion 18, an inwardly sloping plate portion 38, and an attachment flange 40. Slots 42 in the attachment flange 40 can receive fittings 44 by which the panel 14 is attached to the sheathing 141 and frame elements 142 of the building 10.

When the panel 14 is assembled with another similar panel 14A, an edge 50 of the short curved portion 35, which connects the return bend flanges 34 and 36, engages the bead 28 of sealant to form a seal between edge seal forming portions of the panels 14 and 14A.

The panels 14 form a continuous sealed structure with the fasteners 44 being surrounded by the edge seal forming portions.

The roof panel structure illustrated in the drawings and described above is subject to structural modification without departing from the spirit and scope of the appended claims.

Having described our invention, what we claim as new and desire to secure by Letters Patent is:

1. A roofing panel which comprises a body plate portion and edge attaching portions along opposite edges of the body plate portion, a first one of the edge attaching portions including an outwardly extending plate portion extending from a first one of the opposite edges, a bridge plate portion offset from the body portion and extending from the outwardly extending plate portion, a transition portion, and a return bend flange portion connected to the bridge plate portion by the transition portion and extending toward the outwardly extending plate portion, a sealant strip extending lengthwise of the transition portion and facing the space between the bridge plate and return bend flange portions, the second of the edge attaching portions including, in series, an outwardly extending plate portion extending from a second one of the opposite edges, a bridge plate portion extending from the outwardly extending plate portion and offset from the body plate portion, a first return bend flange of the second edge attaching portion, a transition portion of the second edge attaching portion, a second return bend flange of the second edge attaching portion, an inwardly extending plate portion, and an attachment flange, there being means in the attachment flange for attaching the attachment flange to a sheathing member, the transition portion of the second edge attaching portion being adapted to engage the sealant strip of an adjacent similar panel to form a seal therebetween.

2. In combination, a first roofing panel and a second roofing panel, each of said roofing panels comprising a body plate portion and edge attaching portions along opposite edges of the body plate portion, a first one of the edge attaching portions including an outwardly extending plate portion extending from a first one of the opposite edges, a bridge plate portion offset from the body portion and extending from the outwardly extending plate portion, a transition portion, and a return bend flange portion connected to the bridge plate portion by the transition portion and extending toward the outwardly extending plate portion, a sealant strip extending lengthwise of the transition portion and facing the space between the bridge plate and return bend flange portions, the second of the edge attaching portions including, in series, an outwardly extending plate portion extending from a second one of the opposite edges, a bridge plate portion offset from the body plate portion, a first return bend flange of the second edge attaching portion, a transition portion of the second edge attaching portion, a second return bend flange of the second edge attaching portion, an inwardly extending plate portion, and an attachment flange, there being means in the attachment flange for attaching the attachment flange to a sheathing member, the transition portion of the second edge attaching portion of the first roofing panel engaging the sealant strip of the second roofing panel to form a seal between the roofing panels.

3. A combination as in claim 2 in which the return bend flange portion of the first edge attaching portion of the first roofing panel extends between the bridge plate portion and the first return bend flange of the second attaching portion of the second roofing panel.

4. In combination, a first roofing panel and a second roofing panel, each of said roofing panels comprising a body plate portion and an edge attaching portion along an edge of the body plate portion, the edge attaching portion of the first roofing panel including an outwardly extending plate portion extending from the body plate portion of the first roofing panel, a bridge plate portion offset from the body portion thereof and extending from the outwardly extending plate portion, a transition portion extending from the bridge plate portion, and a return bend flange portion extending from the transition portion toward the outwardly extending plate portion, a sealant strip extending lengthwise of the transition portion of the first roofing panel and facing the space between the bridge plate and return bend flange portions, the edge attaching portion of the second roofing panel including, in series, an outwardly extending plate portion extending from the body plate portion of the second roofing panel, a bridge plate portion offset from the body plate portion of the second roofing panel, a first return bend flange of the second roofing panel, a transition portion of the second roofing panel, a second return bend flange of the second roofing panel, an inwardly extending plate portion, and an attachment flange, there being means in the attachment flange for attaching the attachment flange to a sheathing member, the transition portion of the second roofing panel engaging the sealant strip to form a seal between the roofing panels.

5. A method of manufacturing a sheet metal roofing panel having first and second edge attaching portions which method comprises forming a metal panel to an intermediate form in which a bridge plate portion and return bend flange are coupled by a curved transition portion having a concave face facing a smaller angle included between the bridge plate portion and the return bend flange, forming and adhering a bead of sealant to the concave face of the curved transition portion and further forming the intermediate form metal panel so the curved transition portion supports the return bend flange in spaced opposed relation to the bridge plate portion as a first edge attaching portion.

6. A method of manufacturing a sheet metal roofing panel having parallel first and second edge attaching portions which method comprises roll forming a metal panel to an intermediate form in which a bridge plate portion and return bend flange are coupled by a curved transition portion having a concave face facing a smaller angle included between the bridge plate portion and the return bend flange, forming and adhering to the concave face of the curved transition portion a bead of sealant which remains substantially permanently soft, flexible, tacky and non-sagging under temperature and other conditions of normal panel exposure, further roll forming the intermediate form metal panel so the curved transition portion supports the return bend flange in spaced opposed relation to the bridge plate portion with the sealant bead extending between the opposed bridge plate and return bend flange to provide a panel having a first edge attaching portion.

* * * * *